US010281225B2

(12) United States Patent
Shamrai

(10) Patent No.: US 10,281,225 B2
(45) Date of Patent: May 7, 2019

(54) SELF-LOADING PISTOL WITH SELECTIVE SLIDE LOCK DELAYING THE OPENING MOVEMENT DURING FIRING BUT FACILITATING MANUAL COCKING

(71) Applicant: Viktor Shamrai, Ternopol (UA)

(72) Inventor: Viktor Shamrai, Ternopol (UA)

( * ) Notice: Subject to any disclaimer, the term of this patent is extended or adjusted under 35 U.S.C. 154(b) by 0 days.

(21) Appl. No.: 15/770,894

(22) PCT Filed: Oct. 18, 2016

(86) PCT No.: PCT/IB2016/056246

§ 371 (c)(1),
(2) Date: Apr. 25, 2018

(87) PCT Pub. No.: WO2017/077412

PCT Pub. Date: May 11, 2017

(65) Prior Publication Data

US 2018/0328683 A1 Nov. 15, 2018

(30) Foreign Application Priority Data

Nov. 5, 2015 (CZ) ..... 2015-782

(51) Int. Cl.
*F41A 17/00* (2006.01)
*F41A 5/24* (2006.01)
(Continued)

(52) U.S. Cl.
CPC ..... *F41A 5/24* (2013.01); *F41A 3/38* (2013.01); *F41A 5/02* (2013.01); *F41A 19/47* (2013.01); *F41A 21/488* (2013.01); *F41C 3/00* (2013.01)

(58) Field of Classification Search
CPC .. F41A 5/24; F41A 17/00; F41A 17/36; F41A 17/42; F41A 11/00; F41A 3/72
(Continued)

(56) References Cited

U.S. PATENT DOCUMENTS 1,176,254 A * 3/1916 Smith ..... F41A 3/12 42/7
2,115,041 A * 4/1938 Obregon ..... F41A 11/00 42/70.02
(Continued)

FOREIGN PATENT DOCUMENTS

CZ 301 336 1/2010
CZ 302 650 8/2011
(Continued)

OTHER PUBLICATIONS

CZ Search Report, dated Aug. 2, 2016.
PCT Search Report, dated Jan. 27, 2017.

*Primary Examiner* — Michael D David
(74) *Attorney, Agent, or Firm* — Dority & Manning, P.A.

(57) ABSTRACT

A self-loading-pistol includes a slide slidably mounted on a frame and coupled to a recoil spring, with a support plate formed in a front portion of the slide. A barrel passes through the slide and is fixedly mounted on the frame. A slide lock mechanism locks the slide during firing of the pistol and is arranged in the front portion of the frame under the barrel. The slide lock mechanism includes a front seat formed on a front arm of a two-armed lever, a locking member mounted in the front seat, a rear seat formed on a rear arm of the two-armed lever, and a damping member mounted in the rear seat. The locking member and the damping member are pushed upwards to the front seat and the rear seat by a locking spring. A support surface is formed on the rear arm of the two-armed lever and extends to an aperture in the frame.

2 Claims, 5 Drawing Sheets

(51) Int. Cl.

| | |
|---|---|
| ***F41A 3/38*** | (2006.01) |
| ***F41A 5/02*** | (2006.01) |
| ***F41A 19/47*** | (2006.01) |
| ***F41C 3/00*** | (2006.01) |
| ***F41A 21/48*** | (2006.01) |

(58) Field of Classification Search
USPC ..... 89/179, 148, 138, 196; 42/70.01
See application file for complete search history.

(56) References Cited

U.S. PATENT DOCUMENTS

| | | | | |
|---|---|---|---|---|
| 4,176,584 | A * | 12/1979 | Thomas, Jr. | F41A 17/38 89/138 |
| 4,555,973 | A * | 12/1985 | Timari | F41A 11/04 89/1.4 |
| 4,594,935 | A * | 6/1986 | Smith | F41A 17/36 42/75.02 |
| 5,808,229 | A * | 9/1998 | Bastian | F41A 11/02 89/128 |
| 6,374,526 | B1 * | 4/2002 | Mochak | F41A 17/24 42/70.08 |
| 6,415,702 | B1 * | 7/2002 | Szabo | F41A 17/28 42/70.08 |
| 6,907,814 | B2 * | 6/2005 | Spinner | F41A 11/00 42/70.01 |
| 7,895,933 | B2 * | 3/2011 | Quis | F41A 19/46 42/70.05 |
| 8,087,344 | B2 * | 1/2012 | Siddle | F41A 21/00 42/69.02 |
| 8,312,803 | B2 * | 11/2012 | Oz | F41A 19/34 42/71.02 |
| D712,615 | S * | 9/2014 | Werner | D99/32 |
| 8,887,432 | B2 * | 11/2014 | Oz | F41A 35/06 42/71.01 |
| 9,057,574 | B2 * | 6/2015 | McClave | F41A 17/42 |
| 9,207,032 | B2 * | 12/2015 | Curry | F41A 17/36 |
| 9,448,023 | B2 * | 9/2016 | Sheets, Jr. | F41A 17/46 |
| 9,546,831 | B2 * | 1/2017 | Bandini | F41A 3/44 |
| 2012/0048104 | A1 | 3/2012 | Bryant et al. | |

FOREIGN PATENT DOCUMENTS

| | | |
|---|---|---|
| CZ | 25812 | 8/2013 |
| CZ | 304 686 B6 | 8/2014 |
| CZ | 29030 | 12/2015 |
| DE | 3 109 730 | 11/1982 |
| EP | 0 052 083 | 5/1982 |
| UA | 63 508 | 1/2004 |
| WO | WO 2010/041220 A1 | 4/2010 |

* cited by examiner

SELF-LOADING PISTOL WITH SELECTIVE SLIDE LOCK DELAYING THE OPENING MOVEMENT DURING FIRING BUT FACILITATING MANUAL COCKING

TECHNICAL FIELD

The invention relates to a self-loading pistol which comprises a frame on which is slidably mounted a slide for reciprocating movement, through the front portion of which passes a barrel, which is fixedly and non-movably mounted on the frame. A recoil spring of the slide is mounted on a guide arranged below the barrel. A mechanism for locking the slide during the firing process is arranged in the front portion of the frame under the barrel.

BACKGROUND

Known are pistols CZ-83 made by the manufacturer Česká zbrojovka Uherský Brod, the Czech Republic, and pistols SIG-Saurer P 230 made by the manufacturer J. P. Saurer GmbH, Germany.

These are self-loading-pistols, whose barrel is fixedly and non-movably mounted on a frame. During the firing process, the locking of a barrel channel till the moment of the ejection of a bullet out of the channel and a pressure drop of powder gases take place due to the force of inertia of a massive slide and due to the force of a recoil spring, maintaining the slide during shooting in the frontmost position.

The important features of the above-mentioned pistols include a high degree of accuracy of shooting, since the barrel is fixedly mounted in the frame of the pistol, and the simplicity of the mechanism.

On the other hand, the fact that it is not possible to use high performance ammunition for shooting a pistol with such a locking system appears to be a serious drawback, since to be able to use such ammunition, it would be necessary to increase considerably the weight of the slide, which would lead to an increase in the weight of the whole pistol and would result in a great slide impact force between the slide and the pistol frame on reaching its rearmost position after the shot.

Known is the patent CZ 304686 dated Aug. 22, 2014 and the utility model CZ 25812 dated Aug. 27, 2013 "Lock of a slide of a self-loading-pistol", in which the locking member is formed by a cylinder in a seat of a rigid pistol frame and is forced upwards by a locking spring. Its upper portion extends to the travel path of the locking face of the pistol slide. Consequently, during the firing process, the locking face of the slide leans against a cylinder, which is forced upwards by a locking spring arranged below the cylinder. That secures retaining the opening movement of the slide, which allows the bullet to be ejected out of the barrel channel before it opens.

The advantage of the above-mentioned mechanism of closing the barrel channel during the firing process is primarily its simplicity and also the fact that the barrel can be mounted fixedly in the frame, which permits shooting with a high degree of accuracy.

However, the system has a drawback—namely the inability to pull the slide manually backwards to supply a cartridge from the magazine to the cartridge chamber of the barrel when loading, since during this operation it is necessary to press on the stiff locking spring through the cylinder.

An aim of the invention is to provide a pistol for shooting with high performance ammunition, whereby the barrel of the pistol is fixedly and non-movably mounted on the frame to ensure the accuracy of shooting. The automatic pistol must ensure the reliable locking of the channel of the non-movable barrel until the moment of the bullet exiting the barrel channel and the pressure drop of the powder gases without increasing the weight of the slide and of the whole weapon. The pistol design must provide for a possibility of unrestrained cocking of the slide to supply a cartridge to the barrel during loading.

SUMMARY OF THE INVENTION

Objects and advantages of the invention will be set forth in part in the following description, or may be obvious from the description, or may be learned through practice of the invention.

The objects are achieved by a self-loading pistol whose principle consists in that a mechanism for locking a slide during the firing process comprises a locking member accommodated in a seat in the front arm of a two-armed lever pivotable about its axis, whereby in the rear arm of the two-armed lever is mounted a damping member in a seat. The locking member and the damping member are pressed into their seats upwards by a locking spring arranged below them, and the upper portion of the locking member and the upper portion of the damping member extend in the starting position through the seats to the path of a support plate of the slide.

This arrangement allows the locking of the slide during the firing process, thus preventing the slide from untimely opening before the ejection of the bullet out of the barrel channel, as well as preventing a pressure drop of the powder gases. Furthermore, this arrangement permits unrestrained cocking of the slide manually in order to feed a cartridge from the magazine to a cartridge chamber of the barrel when loading the pistol, since in the starting position, the front portion of the two-armed lever is capable of being freely inclined downwards, and the locking member, projecting downwardly, does not prevent the slide from retracting backwards when being manually cocked.

So as to secure the two-armed lever in the locking position, a support surface is formed on its rear arm. The support surface extends to an aperture in the frame, in which it is coupleable to a lower head of a pivotably mounted locking lever, which is coupleable to a trigger stop. On squeezing the trigger to fire a shot, the two-armed lever is secured in a predetermined position, in which the front arm of the two-armed lever rises along with the locking member and the locking member, which is pressed upwards by the locking spring located below the locking member, stops in the path of the backward movement of the slide, thus preventing it temporarily from opening.

The design can be simplified by a solution in which the locking spring has two arms, its front arm being aligned with the locking member and the rear arm being aligned with the damping member. In this manner, it is easy to obtain the required properties of the pistol.

DESCRIPTION OF DRAWINGS

The principle of the invention is schematically represented in the drawings of a self-loading-pistol, wherein.

DETAILED DESCRIPTION

Figure 1:
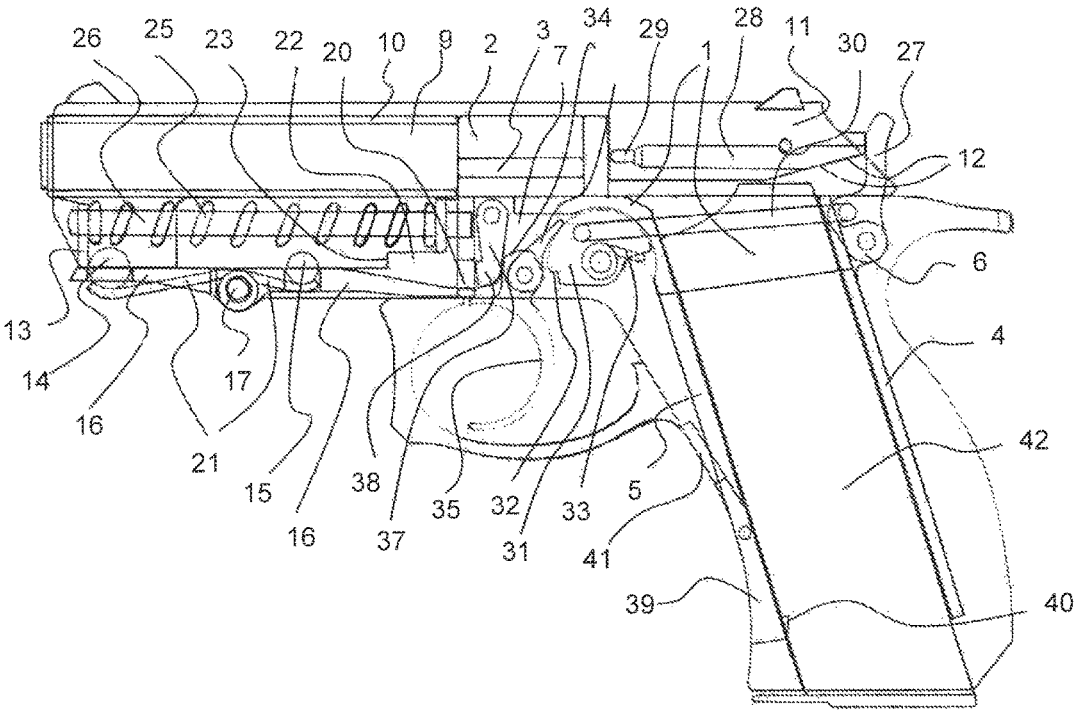
FIG. 1 shows a pistol in a cross-section with all the parts and mechanisms of the pistol in the starting position.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

The self-loading-pistol comprises a frame 1 of the pistol, in which is incorporated a strut 2, in which a barrel 9 is mounted fixedly and non-movably. On the lateral sides of the frame are formed guides 3 for a backward sliding movement of a slide 11. In the rear portion of the frame 1 a grip protrudes downward from the frame, consisting of a rear wall 4 and a front wall 5, between which is formed a space for inserting a magazine 42. The magazine 42 is secured in the grip of the frame 1 by a detent 39, which is mounted on its axis in the front wall 5. At one (upper) end, the detent 39 has a cap 41 to be pressed by the finger, whereas at the other end is formed a nose 40, which, with the magazine engaged, fits in the aperture 43 in the magazine 42 thus locking its position. In the rear portion of the frame 1 are provided loops 6 for mounting the hammer 27.

In a first embodiment, under the barrel 9 in the frame 1 is mounted a body 22 of the mechanism for locking the slide 11, in whose upper rear portion is formed an aperture 24 for the passage of a guide 26, on which the body 22 of the mechanism for locking the slide 11 is mounted, as well as a recoil spring 25 of the slide 11. The body 22 of the mechanism for locking the slide 11 may be designed as one whole with the frame 1. In the front portion of the slide 11 is formed and fixedly mounted a support plate 13 of the slide, on which abuts from its inner side a recoil spring 25 of the slide, whose other end abuts on the body 22 of the mechanism for locking the slide. On the body 22 of the mechanism for locking the slide, struts 23 are provided on both sides for the limiting of the movement of the slide 11 backwards after a shot. In the front portion of the frame 1 under the barrel 9 is arranged a mechanism of locking the slide 11 during shooting, which comprises a locking member 14 mounted in a seat 18 formed in the front arm of a two-armed lever 16 that is pivotable about the axis 17. In the rear arm of the two-armed lever 16 is formed a seat 19, which accommodates a damping member 15. The locking member 14 and the damping member 15 are pressed into its seats by means of a locking spring 21, which is in the illustrated embodiment composed of a two-armed spring arranged on the axis 17, whose front arm leans against the bottom of the locking member 14 and whose rear arm leans against the bottom of the damping member 15. Both the locking member 14 and the damping member 15 are in the illustrated embodiment formed by cylinders, mounted in the seats 18, 19 created in the two-armed lever 16. The seats 18, 19 are directed upwards, having narrowing recesses which enable the cylinders to extend to the space above the two-armed lever 16 to the travel path of the support plate 13 of the slide 11, preventing them from passing through these seats 18, 19. That means that the width of a particular recess is smaller than the diameter of a particular cylinder, constituting the locking member 14 or the damping member 15, as shown in FIG. 6*c*.

Figure 6A:
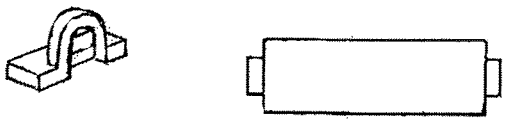
FIG. 6*a* is the first variant of the seats for mounting the locking and damping members.
Figure 6B:
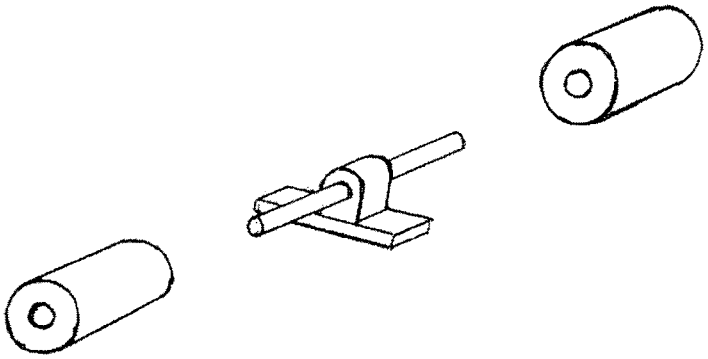
FIG. 6*b* is the second variant of the seats for mounting the locking and damping members.
Figure 6C:
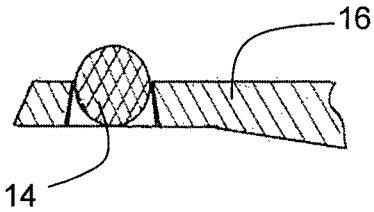
FIG. 6*c* is the third variant of the seats for mounting the locking and damping members.
Figure 7:
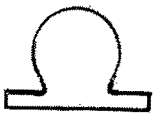
FIG. 7 is the shape of a part which can replace the cylinder of the locking or damping member.
Figure 8:
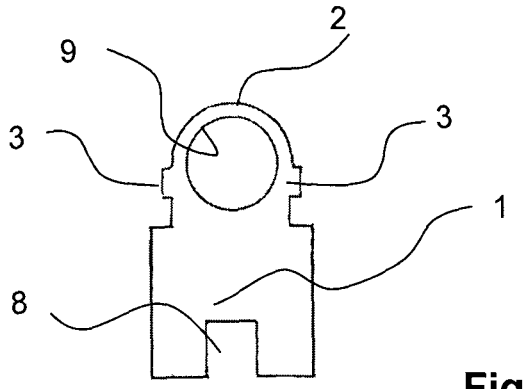
FIG. 8 is a view of the front wall of the strut of the pistol frame for mounting the barrel and having an aperture for the support surface of the rear portion of the two-armed lever and for the lower head of the locking lever.
Figure 9:
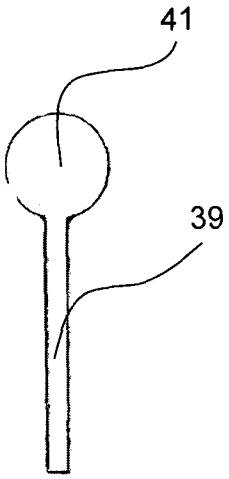
FIG. 9 is a frontal view of a magazine detent with a cap to be pressed by the middle finger of the hand when being turned off.
Figure 10:
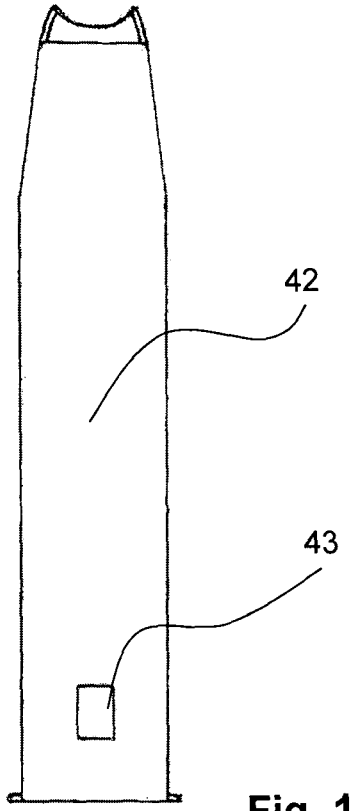
FIG. 10 is a view of the front wall of the body of the magazine with an aperture for a nose of the magazine detent.

Other variants of the locking member 14 and the damping member 15 are shown in FIGS. 6*a* and 6*b*.

Figure 2:
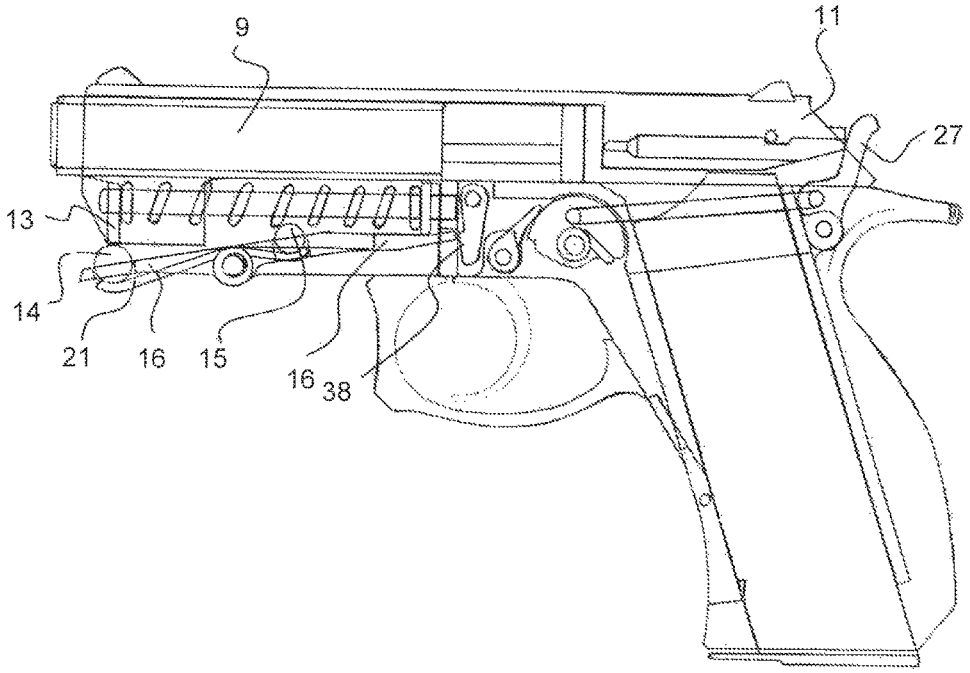
FIG. 2 shows the pistol in a cross-section, wherein the components of the mechanism for locking the slide are in the position during the retracting of the slide to the rear manually when loading.
Figure 3:
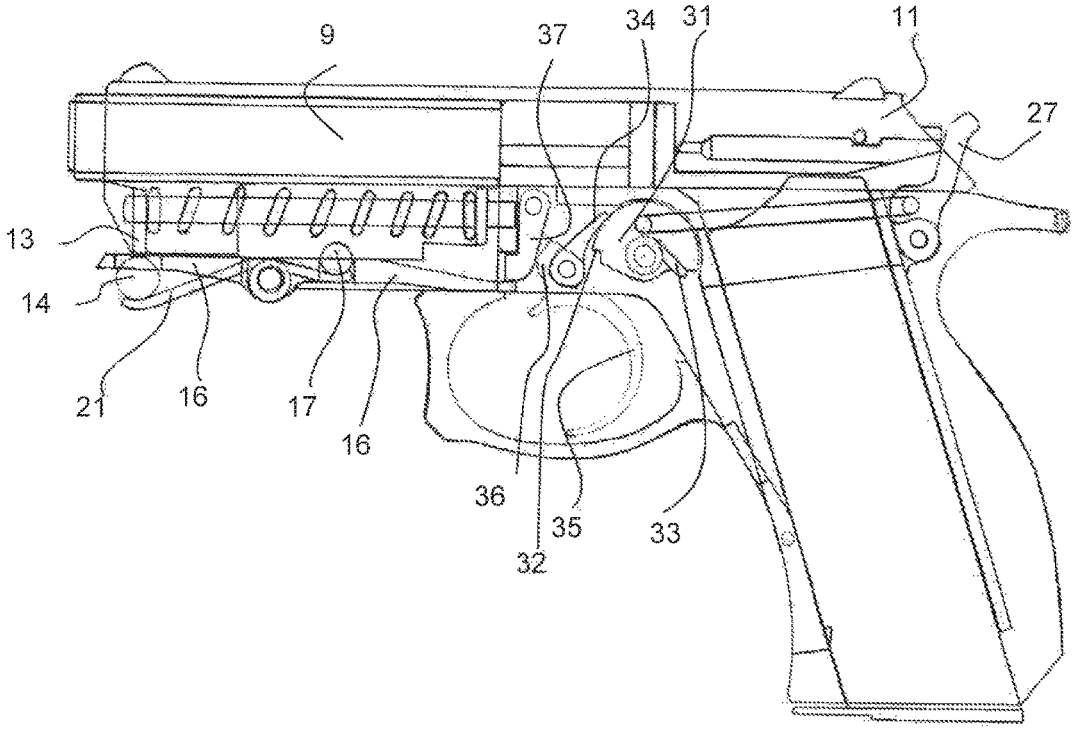
FIG. 3 represents the pistol in a cross-section, wherein the components of the mechanism for locking the slide are in the position during the movement of the slide backwards after a shot.
Figure 4:
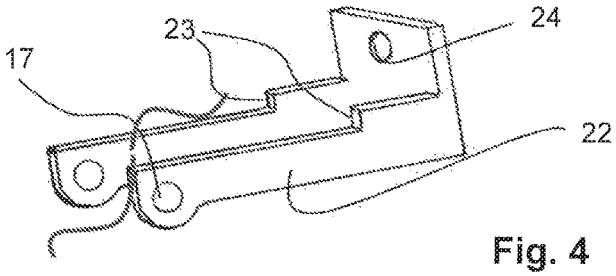
FIG. 4 illustrates the body of the mechanism for locking the slide.
Figure 5:
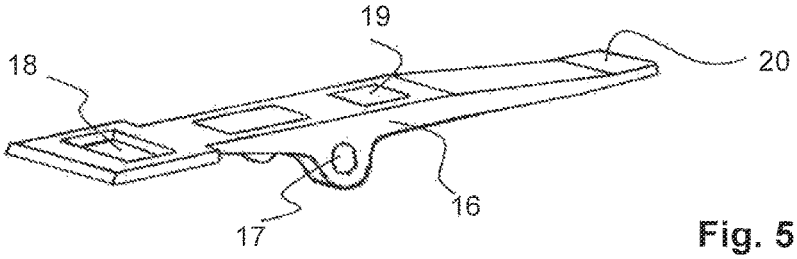
FIG. 5 is a two-armed lever of the mechanism for locking the slide.

At the end of the rear arm of the two-armed lever 16 is provided an end portion with a support surface 20, which extends to an aperture 8 formed in the front wall of the frame 1 under the strut 2. The end portion of the two-armed lever 16 is able to assume in the aperture 8 two positions: a position during the manual cocking of the slide 11, illustrated in FIG. 2, in which the support surface 20 rises towards the upper wall of the aperture 8, whereby it does not have to touch it, and a position during firing, in which the end portion of the two-armed lever 16 is situated in the lower portion of the aperture 8 and is in this position secured by the head 38 of the locking lever 37, which extends to the aperture 8 between the support surface 20 of the rear portion of the two-armed lever 16 and the upper portion of the aperture 8.

The locking lever 37 is pivotably mounted in a space 7, which is created under the strut 2 for mounting the barrel 9 and serves to accommodate parts of the striking and trigger mechanisms. In the lower part of the space 7 is pivotably mounted a trigger 35, on which is provided an upper stop 36, which is coupleable to the pivotably mounted locking lever 37, on whose lower portion is formed a head 38, which is during the firing process able to extend to the aperture 8 and secure in it the rear end of the two-armed lever 16. On the axis common to the trigger 35 is pivotably mounted a hammer stop 34, whose end portion abuts on the working surface of the control cam 31 of the hammer 27. The working surface of the control cam 31 is in the lower portion terminated by a striking protrusion 32, which in the cocked position of the hammer 27 gets caught by the end portion of the hammer stop 34 and keeps the hammer 27 cocked. In an unillustrated embodiment, the hammer stop 34 is mounted on its own axis, different from the axis of the trigger 35.

Figure 11:
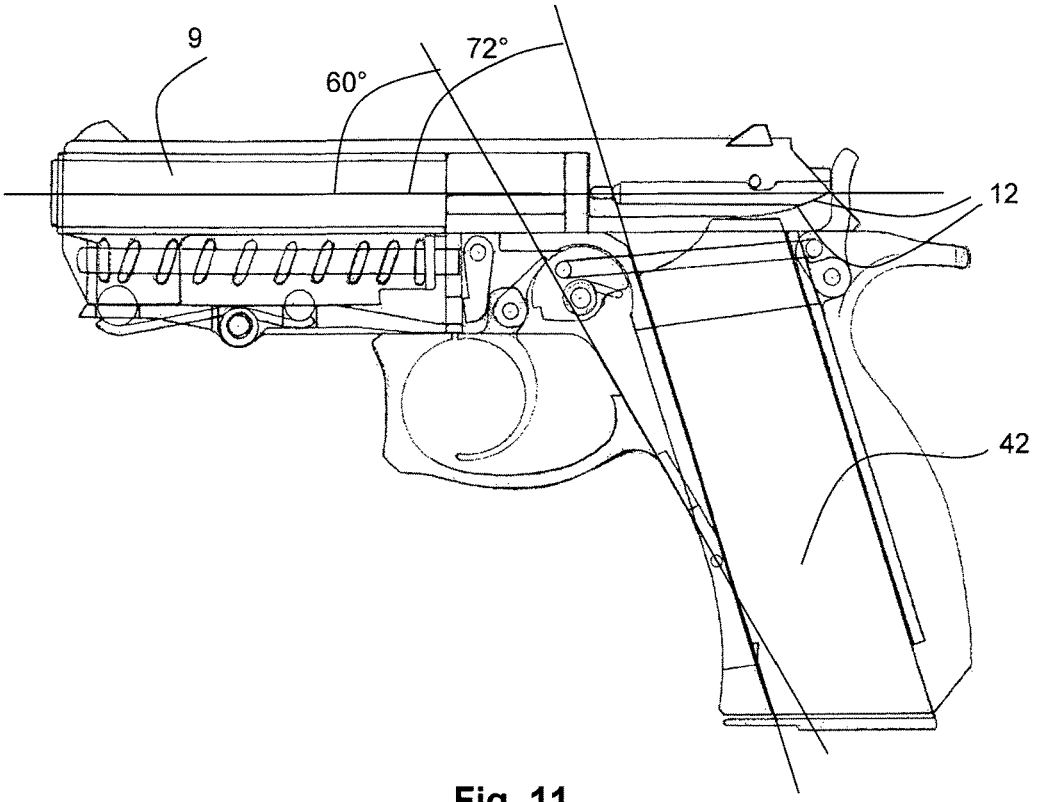
FIG. 11 is a cross-sectional view of the pistol with a possible configuration having curved chamfer in the rear lower portion of the slide and the inclination angle of the magazine relative to the axis of the barrel channel and the inclination angle of the pistol grip relative to the axis of the barrel channel.
Figure 12:
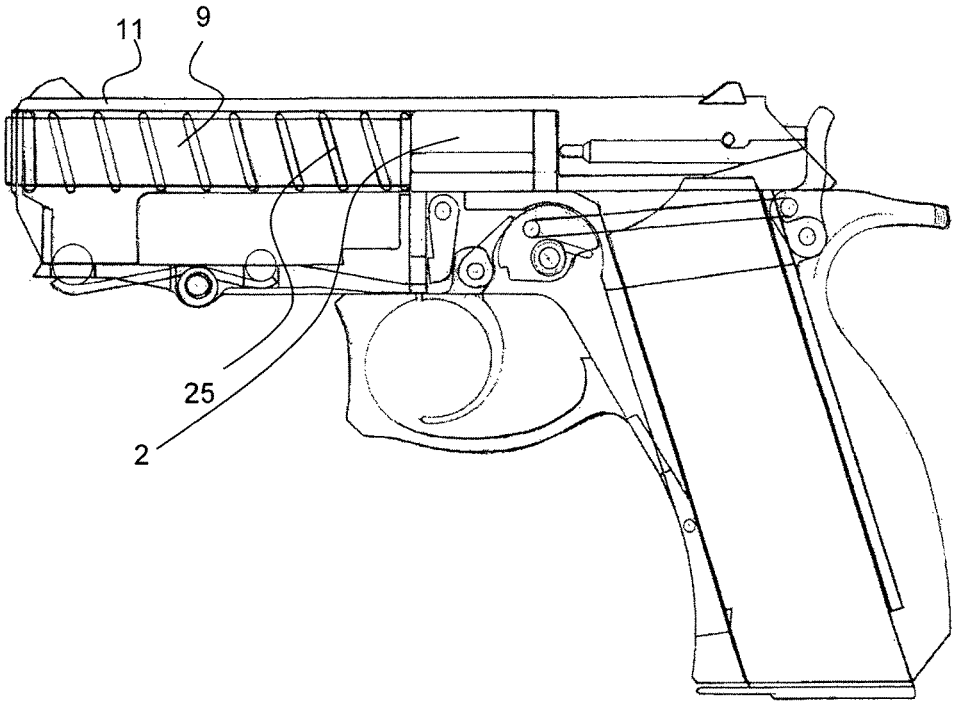
FIG. 12 is a cross-section of an embodiment of the pistol, wherein the recoil spring of the slide is disposed on the barrel.

Between the control cam 31 of the hammer and the frame 11 is arranged a main spring 33, which presses the control cam 31 anticlockwise to cause the hammer 27 to hit the striker 28, which is displaceably mounted in the slide 11 in front of the hammer 27 for forward and backward movement. The control cam 31 is connected to the hammer 27 by a pull rod 30, whose ends are pivotably mounted on both connected components. A firing pin 29 is provided in the front portion on the striker 28. The firing pin 29 serves to strike the percussion cap of the cartridge after firing the shot. In its rear portion the striker 28 has a shape chamfer 12 which is the same as that on the rear lower portion of the slide 11. The chamfer can have various shapes, such as a curved shape, as is shown in FIG. 11. In the other illustrated embodiments, the chamfer is formed by a planar surface. The shape chamfer causes reduction in the force of the recoil movement perceived in the shooter's hand during the automatic cocking of the hammer 27 by the slide 11 after the shot and also facilitates the manual cocking of the hammer 27 during loading. The shape chamfer is known from the Czech patent CZ 305334 from Apr. 12, 2013. Most of the parts of the striking and trigger mechanisms are located in the front portion of the pistol frame 1 under the pistol barrel 9 around the area of the trigger 35. This allows the axis of the barrel channel to be placed so low, which makes it possible to reduce the force of the upward movement of the pistol during the firing process.

A barrel bushing 10 is tightly pressed onto the front portion of the barrel 9. The barrel bushing 10 prevents the barrel 9 from moving forwards or backwards and reduces the oscillation of the barrel 9 during the passage/passing of the bullet and the powder gases through the channel of the barrel 9 during the firing process. The recoil spring 25 of the slide 11 may be arranged on the barrel 9 instead of being mounted on the bushing 10 of the barrel 9.

To achieve a high degree of comfort and convenience in handling the pistol during aiming and firing, the inclination angle of the grip with respect to the axis of the channel of the barrel 9 is 120° or 60°, according to the direction from which the angle is measured. The inclination angle of the magazine 42 relative to the axis of the channel the barrel 9 is 108° or 72°, which ensures reliable feeding of cartridges from the magazine 42 to the cartridge chamber of the barrel 9.

In the starting position (FIG. 1), the slide 11 is situated in the front position and leans against the barrel 9. The hammer 27 along with the control cam 31 are actuated and the main spring 33 is released. The trigger 35 is released and is situated in the front position. The upper stop 36 of the trigger 35 is raised and does not lean against the locking lever 37. The locking lever 37 is in the initial state, its lower head 38 being in the rear position. The magazine 42 is inserted into the pistol grip between the rear 4 and front 5 walls of the frame 1 and is locked against falling out with the nose 40 of the detent 39 of the magazine, which extends to the aperture 43 in the body of the magazine 42.

So as to cock the pistol, it is necessary to hold it by the grip with one hand, retract the slide 11 to the stop with the other hand and allow it to snap forward. During the reciprocating movement of the slide 11 the support plate 13 of the slide smoothly presses the locking member 14 downwards, turning the two-armed lever 16 anticlockwise (FIG. 2), and the slide moves without resistance to the rear, compressing its recoil spring 25. In the rear position of the slide 11 when the slide is cocked manually, the support plate 13 leans against the rear damping member 15. Due to the action of the rear portion of the slide 11 and due to the longitudinal shape chamfer 12 of the slide, the hammer is turned clockwise and by means of the pull rod 30 it causes the control cam 31 of the hammer to turn clockwise. The striking protrusion 32 leans against the stop 34 of the hammer. The main spring 33 is compressed as a result of the rotation of the control cam 31 of the hammer.

After releasing the slide 11 the recoil spring 25 of the slide expands, forcing the slide 11 forwards, the slide 11 strips the top cartridge from the magazine and pushes it into the cartridge chamber of the barrel 9. The pistol is now ready to fire.

To fire a shot, it is necessary to squeeze the trigger 35. By squeezing, the trigger 35 is turned anticlockwise, leans against the locking lever 37 and turns its lower head 38 forwards. The lower head 38 of the locking lever 37 enters the aperture 8 in the front wall of the frame 1, assuming the position between the support surface 20 in the rear portion of the two-armed lever 16 and the upper wall of the aperture 8 in the front wall of the frame 1, by which means the two-armed lever 16 is secured against moving anticlockwise. During another turn, the trigger 35 presses on the hammer stop 34, turning it anticlockwise, by which means the hammer stop 34 is taken out of the striking protrusion 32 of the control cam 31. This results in releasing the main spring 33, which begins to expand vigorously, turning the control cam 31 of the hammer vigorously anticlockwise. Also the hammer 27 will be turned vigorously anticlockwise by means of the pull rod 30, and consequently transmits the energetic strike to the striker 28, which by means of its firing pin 29 transmits the energetic strike to the percussion cap of the cartridge, situated in the cartridge chamber of the barrel 9. After the firing pin breaks the percussion cap, a shot occurs.

During the firing cycle, powder gases press on the slide 11 through the bottom of the cartridge case, trying to push it backwards. The slide 11 transmits the pressure of the powder gases through the support plate 13 of the slide in its front lower portion to the locking member 14, against which the plate 13 leans, trying to push the locking member 14 downwards. The locking member 14 transmits the pressure of the powder gases to the frame 1 through the rear wall of the seat 18 of the two-armed lever 16 backwards and over the locking spring 21 downwards.

During the movement of the bullet through the channel of the barrel 9 the slide 11 receives sufficient energy of the powder gases to overcome the inertial force of the slide 11, the elastic force of the locking member 14, the elastic force of the locking spring 21 and the elastic force of the recoil spring 25 of the slide 11. As a result, after the bullet is ejected out of the channel of the barrel 9, the support plate 13 of the slide pushes the locking member 14 downwards, releasing a path for backward movement along with the slide 11. As the slide moves backwards, it extracts the spent cartridge case from the cartridge chamber of the barrel 9, compressing its recoil spring 25, and due to the pressure of its rear portion and longitudinal shape chamfer 12 acts on the hammer and cocks both the hammer and the control cam 31 of the hammer into the striking position, thereby compressing the main spring 33. As the slide 11 approaches the rearmost position, the support plate 13 of the slide leans against the rear damping member 15 pushing it downwards. At the same time, the locking spring 21 is pressed, or, to be more specific, its rear arm is pressed. Consequently, the slide 11 more continuously and gradually transmits part of the kinetic energy of its movement through the damping member 15 and the locking spring 21 of the pistol frame 1 downwards. After hitting the rear stops 23 on the body 22 of the mechanism for locking the slide, the slide 11 is retracted due to the action of the recoil spring 25 to the starting position and strips the top cartridge from the magazine 42, pushing it into the cartridge chamber of the barrel 9 to perform the next shot.

For removing the magazine 42 from the pistol grip the shooter must press against the cap 41 of the magazine detent 39 towards the grip with the front part of the middle finger of the hand holding the pistol. At the same time, the nose 40 of the magazine detent 39 is released from the body of the magazine 42 and is ejected from its aperture 43. Thus, the body of the magazine 42 is released and can be easily removed from the pistol grip.

In comparison to known pistols with a non-movable barrel, mounted on the frame, the invention allows firing with high performance cartridges, while maintaining relatively low weight of the slide and of the whole pistol.

In addition, the pistol design ensures high accuracy of shooting, reduced recoil movement felt in the shooter's hand, a greater handling ease while aiming and shooting, a greater convenience in turning off the magazine detent while overcharging, as well as better access to the parts of the striking and trigger mechanisms for the purposes of cleaning, lubrication, functional check and repair.

Modifications and variations can be made to the embodiments illustrated or described herein without departing from the scope and spirit of the invention as set forth in the appended claims.

| List of references | |
|---|---|
| 1 | pistol frame |
| 2 | strut for mounting the barrel |
| 3 | guide of the slide |
| 4 | rear wall of the grip |
| 5 | front wall of the grip |
| 6 | loops |
| 7 | space under the strut of the barrel |
| 8 | aperture |
| 9 | barrel |
| 10 | barrel bushing |
| 11 | slide |
| 12 | shape chamfer |
| 13 | support plate of the slide |
| 14 | the locking member |
| 15 | the damping member |
| 16 | two-armed lever |
| 17 | axis |
| 18, 19 | seats |
| 20 | support surface |
| 21 | locking spring |
| 22 | body of the mechanism for locking the slide |
| 23 | stops of the restriction means of the slide |
| 24 | aperture |
| 25 | recoil spring of the slide |
| 26 | guide of the recoil spring |
| 27 | hammer |
| 28 | striker |
| 29 | firing pin |
| 30 | pull rod of the hammer |
| 31 | control cam of the hammer |
| 32 | striking protrusion |
| 33 | main spring |
| 34 | hammer stop |
| 35 | trigger |
| 36 | upper trigger stop |
| 37 | locking lever |

-continued

| List of references | |
|---|---|
| 38 | lower head of the locking levers |
| 39 | magazine detent |
| 40 | nose |
| 41 | cap |
| 42 | magazine |
| 43 | aperture |

The invention claimed is:

1. A self-loading-pistol, comprising:

a frame;

a slide slidably mounted on the frame for reciprocating movement, the slide coupled to a recoil spring;

a support plate formed in a front portion of the slide;

a barrel that passes through the front portion of the slide and is fixedly and non-movably mounted on the frame;

a trigger, the trigger further comprising an upper stop coupled to a pivotably mounted locking lever, the locking lever comprising a head formed on a lower portion thereof;

a slide lock mechanism that locks the slide during firing of the pistol and is arranged in a front portion of the frame under the barrel, the slide lock mechanism comprising a two-armed lever swingingly arranged on an axis;

a front seat formed on a front arm of the two-armed lever, and a locking member mounted in the front seat;

a rear seat formed on a rear arm of the two-armed lever, and a damping member mounted in the rear seat;

a locking spring, wherein the locking member and the damping member are pushed upwards to the front seat and the rear seat, respectively, by the locking spring, and wherein in an initial position, an upper portion of the locking member and an upper portion of the damping member extend to a path of movement of the support plate;

a support surface formed on the rear arm of the two-armed lever and extending to an aperture in the frame;

wherein during manual racking of the slide, the support surface is raised towards an upper portion of the aperture, and during firing the support surface abuts on the head of the locking lever that has entered the aperture due to action of the trigger stop from pulling of the trigger, wherein the two-armed lever is secured against turning anticlockwise and the locking member is maintained in the path of movement of the support plate during movement of a bullet through the barrel until the slide receives sufficient energy from powder gases to overcome resistance and elastic force of the locking member, whereupon during movement to a rear position, the support plate strikes and compresses the damping member such that kinetic energy of the slide is transmitted to the frame.

2. The self-loading-pistol according to claim 1, wherein the locking spring comprises a front arm and a rear arm, the front arm disposed against the locking member located above the front arm, and the rear arm disposed against the damping member located above the rear arm.

* * * * *